US006402350B1

(12) United States Patent
Ward

(10) Patent No.: US 6,402,350 B1
(45) Date of Patent: Jun. 11, 2002

(54) LIGHTING FIXTURE AND METHOD FOR USE IN NON-ACCESSIBLE LOCATIONS

(75) Inventor: Patrick H. Ward, San Antonio, TX (US)

(73) Assignee: Lucifer Lighting Company, San Antonio, TX (US)

( * ) Notice: Subject to any disclaimer, the term of this patent is extended or adjusted under 35 U.S.C. 154(b) by 0 days.

(21) Appl. No.: 09/691,990

(22) Filed: Oct. 19, 2000

Related U.S. Application Data

(60) Provisional application No. 60/160,689, filed on Oct. 21, 1999.

(51) Int. Cl.[7] ..... F21V 7/00; H01J 15/00

(52) U.S. Cl. ..... 362/347; 362/368; 362/150; 174/50

(58) Field of Search ..... 362/374, 375, 362/364, 365, 368, 220, 221, 222, 147, 148, 150; 174/50, 58; 220/3.2, 3.5, 3.6

(56) References Cited

U.S. PATENT DOCUMENTS 2,998,512 A * 8/1961 Duchene et al. ..... 362/364

* cited by examiner

*Primary Examiner*—Sandra O'Shea
*Assistant Examiner*—Bao Truong
(74) *Attorney, Agent, or Firm*—Jenkens & Gilchrist, A Professional Corporation

(57) ABSTRACT

A lighting fixture having a fixture housing, a transformer housing, and a locking means is suitable for installation in non-accessible areas. The transformer housing includes a first stop and second stop, and is pivotally engaged with an access aperture that is part of the fixture housing. The locking means serves to prevent pivotal movement of the transformer housing in relation to the access aperture. The lighting fixture may also have a fixture housing, a transformer recess, and a locking means. In this embodiment, the fixture housing includes an inner stop with which a transformer is pivotally engaged, and the transformer is retained in the recess by the locking means. The lighting fixture also includes a trim assembly.

28 Claims, 8 Drawing Sheets

LIGHTING FIXTURE AND METHOD FOR USE IN NON-ACCESSIBLE LOCATIONS

BACKGROUND OF THE INVENTION

This application claims the benefit under Title 35 United States Code § 19(e) of U.S. Provisional Application No. 60/160,689, filed Oct. 21, 1999, which is incorporated herein by reference in its entirety.

TECHNICAL FIELD

This invention relates to the field of lighting fixtures. More particularly, the instant invention relates to an apparatus and method for manufacture and servicing of a lighting fixture installed in non-accessible areas, such as closed-in ceilings or walls.

HISTORY OF THE RELATED ART

Recessed adjustable lighting fixtures are installed in a variety of locations and provide a uniquely customized approach to illumination. However, the physical construction of such fixtures is often at odds with the installation environment, such that recessed lighting fixtures must be installed in areas which are only accessible through the front face of the fixture. For example, recessed fixtures are often installed in houses with high ceilings, such that the face of the fixture is only inches away from the base of the roof. Thus, installation height restrictions may limit the choice of fixtures to a great extent.

Moreover, it is sometimes necessary to install recessed lighting fixtures in walls, floors, or other locations where closed-installation access will also be limited to that which can be obtained from the front face of the fixture. Additional limitations include those imposed by the National Electric Code, which require direct access to various parts of the fixture, including the transformer or ballast, when no access is available from the top-side of the fixture. In fact, the Code specifies access aperture size in relation to the transformer location, which severely limits access to the transformer in most situations.

A further complication with such fixtures involves the requirement for extra conduit length needed for service. There is no mechanism which forces the fixture installer to set aside sufficient conduit length for service through the front of the fixture face. Remote transformer or ballast mounting may also be required, which further complicates service of the fixture when no other access can be obtained.

Finally, lighting designers prefer fixtures which can be mounted with millwork or plaster stops for a zero sight line, or at least so that the trim sits flush on the fixture mounting surface. The mounted fixture should also exhibit freedom from light spill or leakage from the periphery of the fixture, even when the installation surface is non-planar, and permit rotation and tilting of the lamp housing without trim disassembly, so that the installer or designer can precisely control the amount and direction of illumination.

The contemporary solution to these problems involves complicated rolling-chassis assemblies or very large fixture housings which provides sufficient room for servicing the fixture and its components from the face-side. Light leaks are stopped with silicone gaskets, causing protrusion of the trim away from the installation surface. However, as consumer tastes run to ever-smaller fixtures and zero sight line installations, these solutions are not acceptable. Also, the larger fixture size is often in compatible with the desired location of the fixture.

Therefore, what is needed, is a fixture whose component elements, such as a transformer or ballast, thermal sensor, splice connections, and/or trim, are accessible from the fixture front face, even when the access aperture is relatively small, providing easy service access. It is also important that any such fixture provide the ability for precise positional adjustment after installation, with some mechanism for integrating the trim as a housing constituent to block unwanted light leaks after the fixture i s installed, even in non-planar surfaces.

A simplified method of servicing a fixture in an inaccessible ceiling is al so needed. Such a met hod should provide access to fixture components from the front face, facilitating extraction of the components for repair or replacement.

SUMMARY OF THE INVENTION

One embodiment of the present invention comprises a lighting fixture including a fixture housing with an access aperture, a transformer housing, and a locking means to engage the transformer housing with the aperture. The fixture also includes a light-blocking trim engagement means for rotatable engagement of a trim ring with the fixture.

The fixture housing typically includes a neck aperture through which a transformer, wiring, and other elements of the fixture can be inserted and retrieved for repair or replacement. Typically, the transformer housing is pivotally engaged with the fixture housing by means of the access aperture, and locked into place using a pair of locking ears (tabs, levers, cams, etc. can also be used). The transformer housing may contain access ports for ventilation and wiring access. Alignment marks may be placed upon the fixture housing and the transformer housing for easy assembly after repairs or installation.

The method of the present invention for servicing an inaccessible lighting fixture comprises the steps of removing the trim assembly, disengaging the locking means (e.g. ears) from the transformer housing, rotating the housing away from the access aperture, disengaging the housing from the fixture housing, pulling the transformer housing through the access aperture, and extracting the transformer housing from the fixture housing by pulling the transformer housing through the neck aperture. A transformer may be attached directly to the transformer housing, and additional service steps may include disconnecting wiring (which includes flexible conduit, non-metallic sheathed cable, stranded and solid wire, and the like) from the transformer and drawing the wiring through the access ports in the transformer housing.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF PRESENTLY PREFERRED EMBODIMENT

Figure 1A:
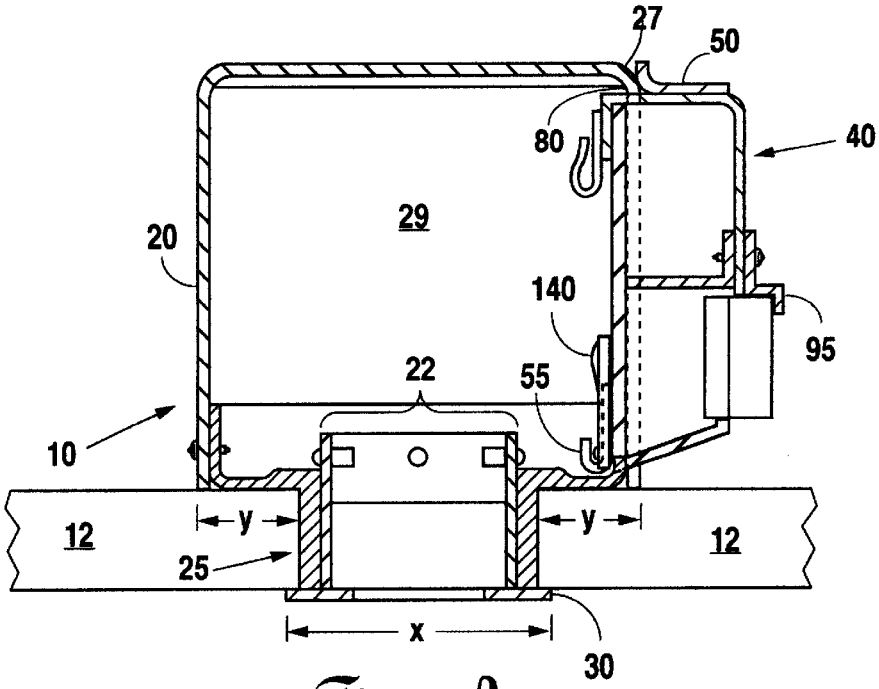
FIGS. 1A and 1B illustrate side, cross-sectional views of the fixture of the present invention in fully-assembled and partially-assembled views, respectively.

Turning now to FIG. 1A, a cross-sectional, side-view of the present invention can be seen. The lighting fixture 10 mounted in a ceiling 12 comprises a fixture housing 20, a ballast and/or transformer housing 40, and a locking means 140. The fixture housing 20 is typically constructed of aluminum, although many other materials may be used, as is well known to those skilled in the art. The housing 20 includes an outer surface 27, an inner surface 29, and an access aperture 80. The present invention provides complete access to the inner elements making up the fixture 10 as measured by the distance X (i.e., the approximate diameter of the trim ring 30) of less than about 8.5 cm, which is substantially less than that provided by the prior art.

Figure 1B:
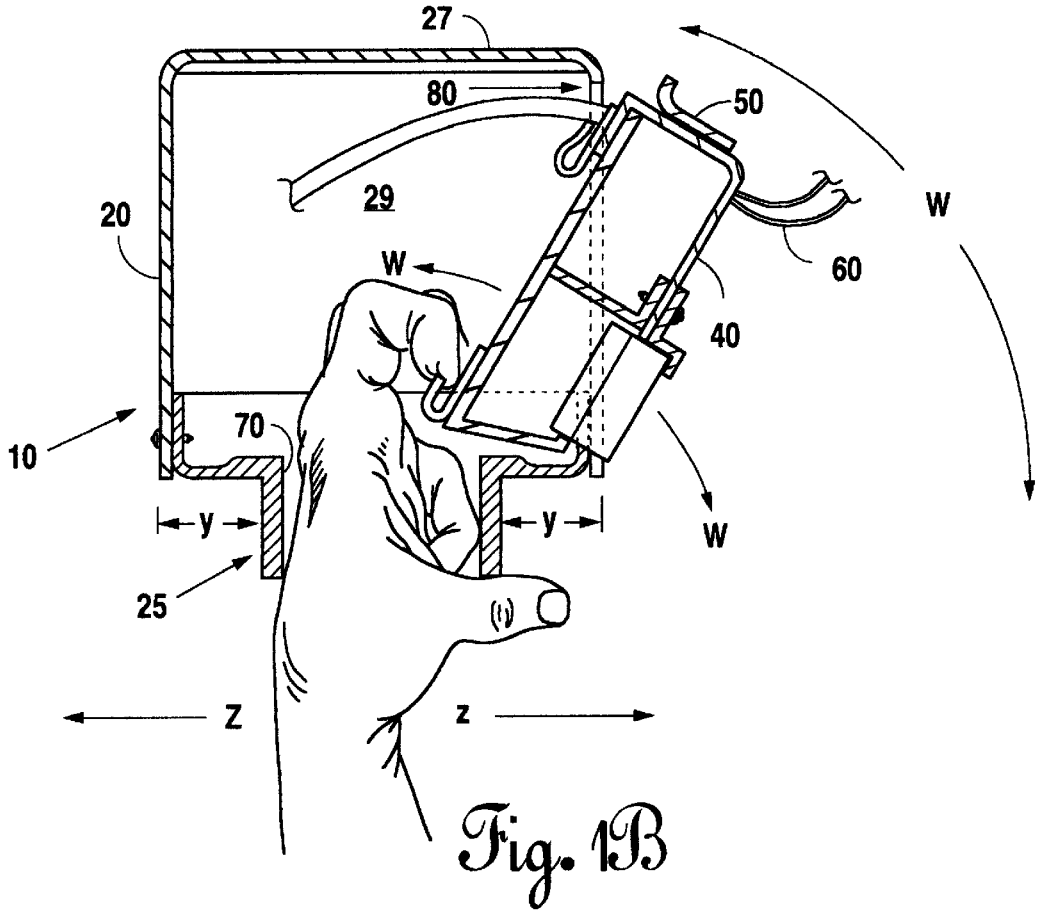

As shown in FIG. 1A, the transformer housing 40 includes a first stop 50 and a second stop 55. When fully assembled, the first stop 50 of the transformer housing 40 rests against the outer surface 27 of the fixture housing 20. The second stop 55 of the transformer housing 40 rests against the inner surface 29 of the fixture housing 20. The transformer housing is pivotally engaged (along path "W") with the access aperture 80, as can be seen in FIG. 1B. A locking means 140 is used to retain the transformer housing 40 in a fixed positional relationship with the fixture housing 20. The locking means 140 prevents pivotal movement of the transformer housing 40 in relation to the access aperture 80, and provides fixed engagement with the aperture 80.

The fixture 10 may be designed in a number of different ways. To minimize the trim ring 30 diameter dimension X, while leaving sufficient room for manipulation of the transformer housing 40 within the fixture housing 20, and extraction therefrom, the size of the fixture housing 20 is typically enlarged in the horizontal direction Z to create a shoulder width of dimension Y. Thus, although the trim ring diameter X is relatively small, the dimension of the fixture housing 20 in the horizontal direction Z may be larger by an additional amount of approximately 2*Y.

Similarly, while a neck 25 is not absolutely required to construct the fixture 10 of the present invention, it is convenient with respect to installation of the fixture 10 when the length of the neck 25 is approximately equal to the thickness of the material within which the fixture 10 is installed. For example, if the fixture 10 is installed in sheet rock that is approximately 1.6 cm. thick, then the length or height of the neck 25 should also measure approximately 1.6 cm. However, if the fixture housing 20 is attached directly to a thin mounting surface, such as a metal ceiling, the height or length of neck 25 may be negligible. In any case, the neck aperture 70 is the access means by which the transformer housing 40 and other elements of the fixture 10 are removed and serviced from the fixture 10.

Figure 2:
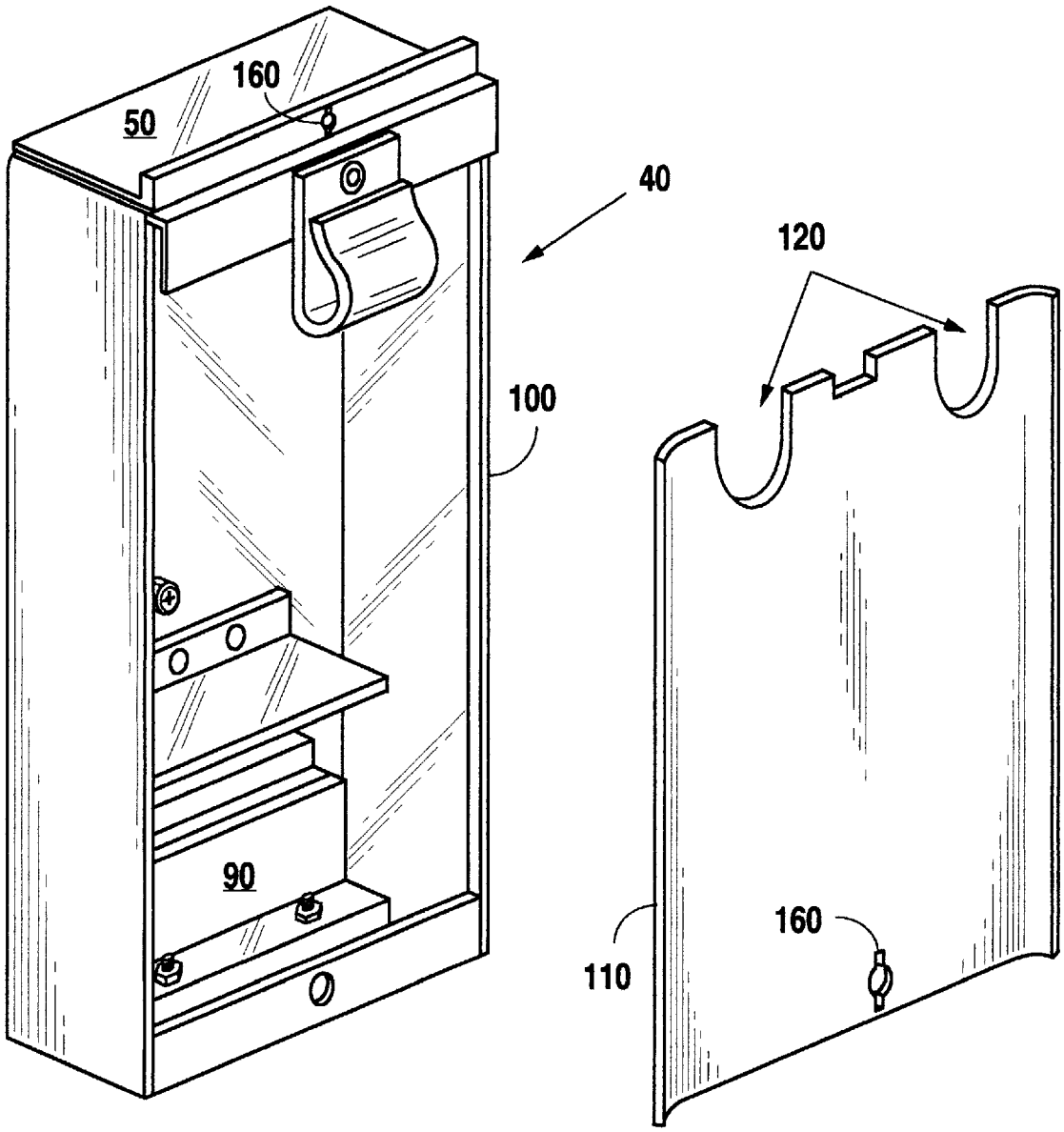
FIG. 2 is a front-perspective view of the transformer housing of the present invention.
Figure 3:
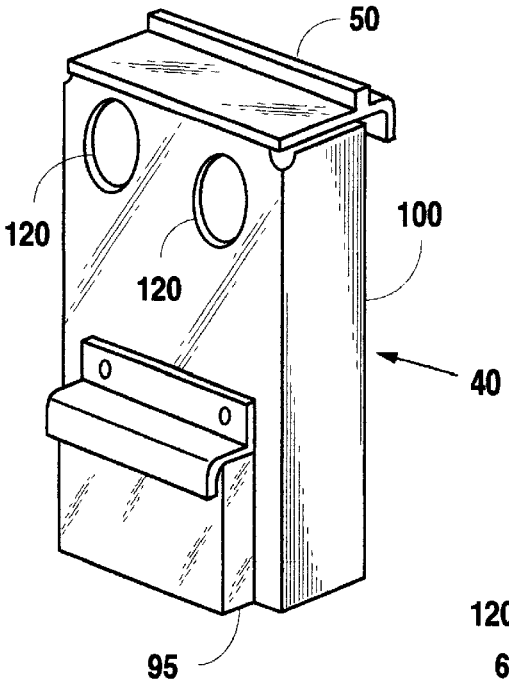
FIG. 3 is a rear-perspective view of the transformer housing of the present invention.

Referring now to FIG. 2, a more detailed view of the transformer housing 40 can be seen. The first stop 50 is typically attached to the top of the transformer housing 40 as shown. The transformer 90 may be mounted within the shell 100 of the transformer housing 40, or alternatively, on the exterior of the shell 100, as shown in FIG. 3. The face 110 of the transformer housing 40 may be separable from the shell 100, and may include access ports 120, through which wire entry into the fixture is enabled. Further, the access ports 120 may operate to ventilate the fixture housing 20 and/or the transformer housing 40. The access ports 120 may be located on the face 110 of the transformer housing 40 and/or on the shell 100 of the transformer housing 40, as shown in FIG. 3.

Figure 4:
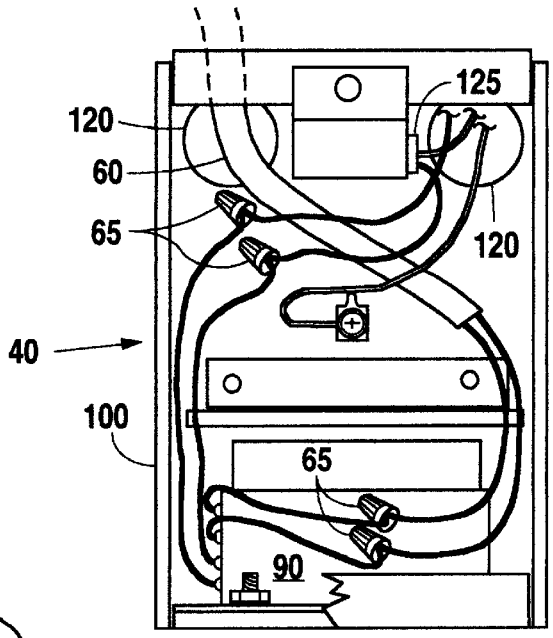
FIG. 4 is a front, cut-away, view of the transformer housing of the present invention.

FIG. 4 illustrates the interior of the transformer housing 40. As shown, the transformer 90 is connected by means of wiring 60, via access ports 120 and splices 65, to the main supply voltage. There may be additional wiring 60 which includes a thermal cutoff module 125, for example, which also enters the transformer housing 40 by means of the access ports 120. The transformer 90 is typically fixedly attached to the shell 100.

Figure 5:
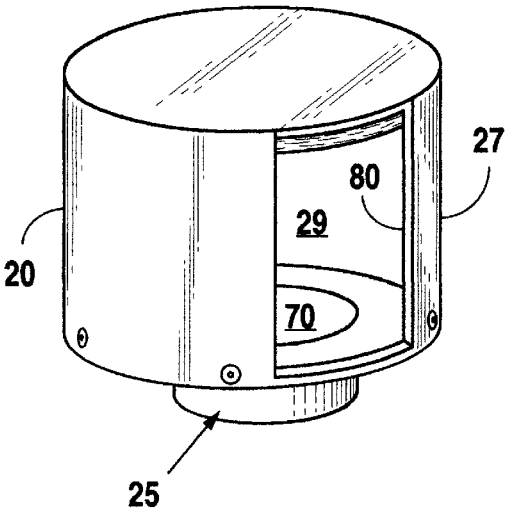
FIG. 5 is a perspective view of the fixture housing of the present invention, illustrating the access aperture.

FIG. 5 clearly illustrates the fixture housing 20 with a rectangular access aperture 80. Also shown is the neck aperture 70 and the neck 25. FIG. 5 illustrates the appearance of the fixture housing 20 when all of the elements accessible by means of the neck aperture 70 have been removed from the fixture 10. As can be easily seen, no components which are likely to fail, such as the transformer 90, thermal cutoff module 125, etc. are left behind. Further, since the installation of the electrical components of the fixture 10 are typically accomplished after the fixture housing 20 has been installed, the installation contractor is forced to use wiring 60 of a length sufficient to support convenient installation and repair when the fixture 10 is accessed by means of the neck aperture 70.

Figure 6:
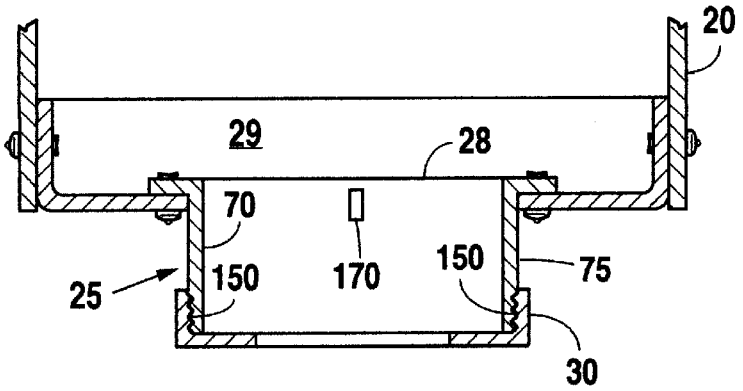
FIGS. 6, 7, 8A, 8B and 9 illustrate partial-front, cut-away, views of the trim installation for the lighting fixture of the present invention.

FIGS. 6, 7, 8A, 8B and 9 illustrate various versions of trim ring 30 installation which can be accommodated by the fixture 10. While these are by no means the only arrangements available, they represent a selection of commonly-used structures. FIG. 6 illustrates a trim ring 30 which is rotatably engaged with a trim engagement means, such as threads 150 to the fixture housing 20. In this example, the trim ring 30 is simply screwed onto, or off of, the neck outer surface 75 by means of the threads 150 or some other form of inclined plane or ramped engagement.

Figure 7:
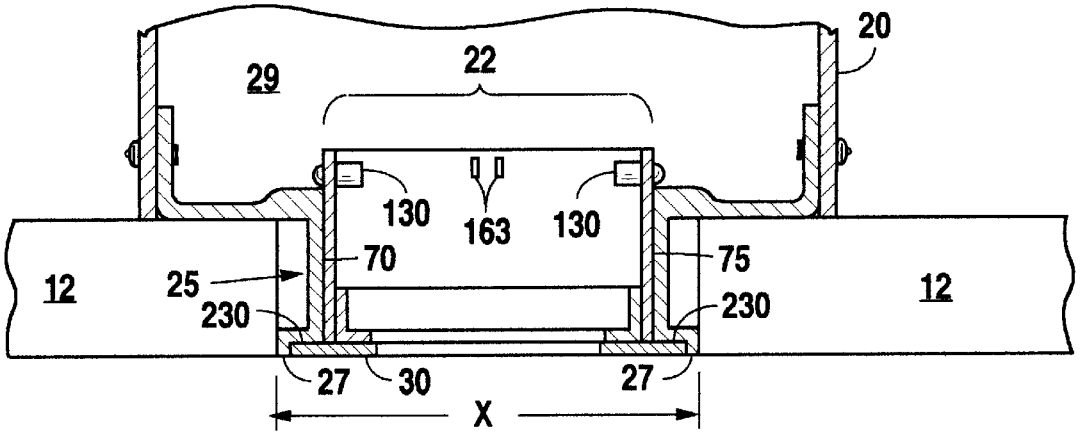
Figure 8A:
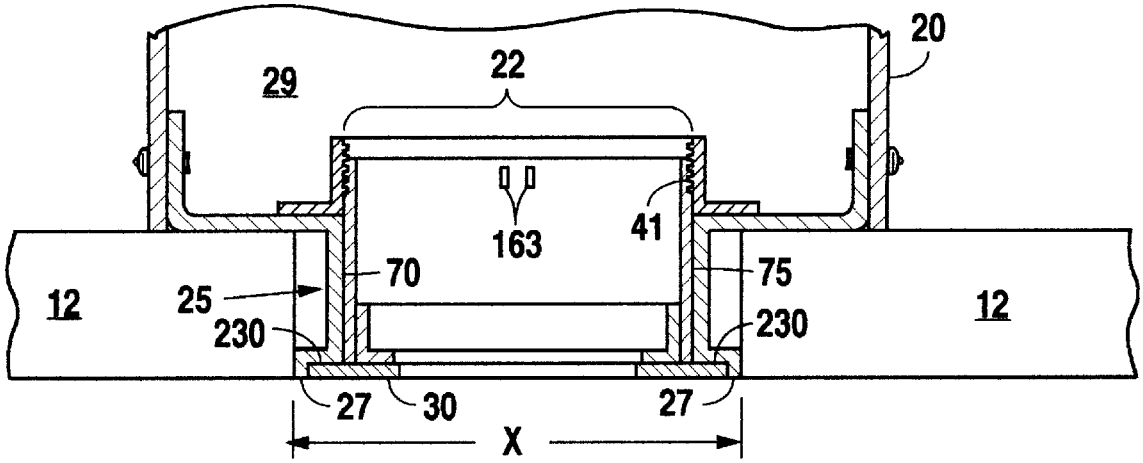
Figure 8B:
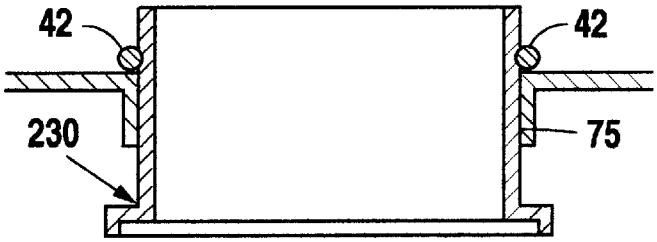

FIG. 7 illustrates a trim ring 30 and neck 25 installation arrangement which provides zero sight line trim installation in the ceiling 12. In this example, the trim ring 30 diameter X is approximately the same diameter as the installation hole required to accommodate the neck shoulders 27. The trim assembly 22 engaging the ledge 28 of the neck 25 is secured to the fixture housing 20 by the means of one or more ball-bearing plungers 130. Use of such plungers 130 provides rotatable positioning of the trim assembly 22 without removing the fixture 10 from the original mounting location (use of threads 150 also provides this advantage. Further, the use of such ball-bearing plungers 130 eliminates the need for conventional flange clips as a means of trim assembly 22 retention. The lamp assembly (not shown) mounted to the trim assembly 22 can be tilted using the conventional swivel mounting, as is well know in the art, and illustrated in the Lucifer Lighting Company catalogs for their recessed adjustable downlight pinhole fixtures, such as for model DL2RZ-1 and DL2RZ-2 fixtures, incorporated herein by reference in their entirety. As shown in FIGS. 8A and 8B, frictional or ratcheting mechanisms 41 and compression springs 42 can also be used in place of the plungers 130 as a trim engagement means.

Figure 9:
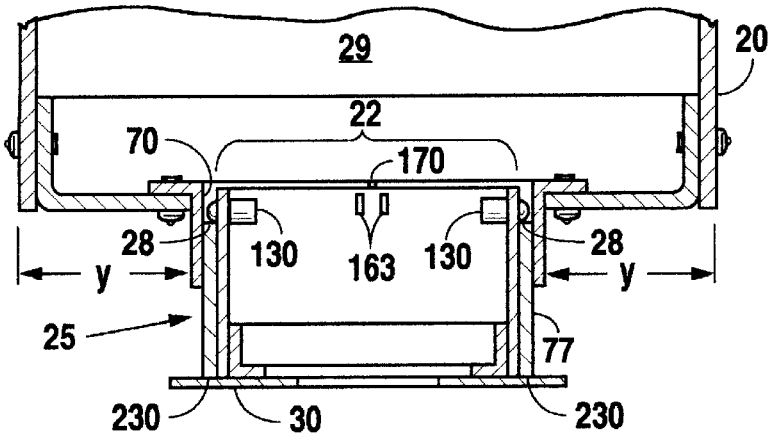

FIG. 9 illustrates a trim assembly 22 installation arrangement with minimal flange protrusion (i.e. not zero sight line, but nearly flush) over the installation aperture. In the case of FIGS. 7, 8A, 8B and 9, there is no light leakage from within the fixture housing 20 because the contact surface or shelf 230 between the neck 25 and the trim ring 30 acts to stop light leaks around the periphery of the neck 25. The inner collar 77 allows the housing 20 to adapt to a variety of mounting surface 12 thicknesses. Also, each of the trim installation illustrations (i.e. FIGS. 6, 7 and 8) provides for installation, removal, and repair of the fixture 10 electronic elements, such as the transformer 90, by way of the neck aperture 70. In each case, the trim assembly 22, which includes the trim ring 30, is easily removed such that access to the inner surface 29 of the fixture housing 20 can be achieved from the face of the fixture 10.

Figure 10:
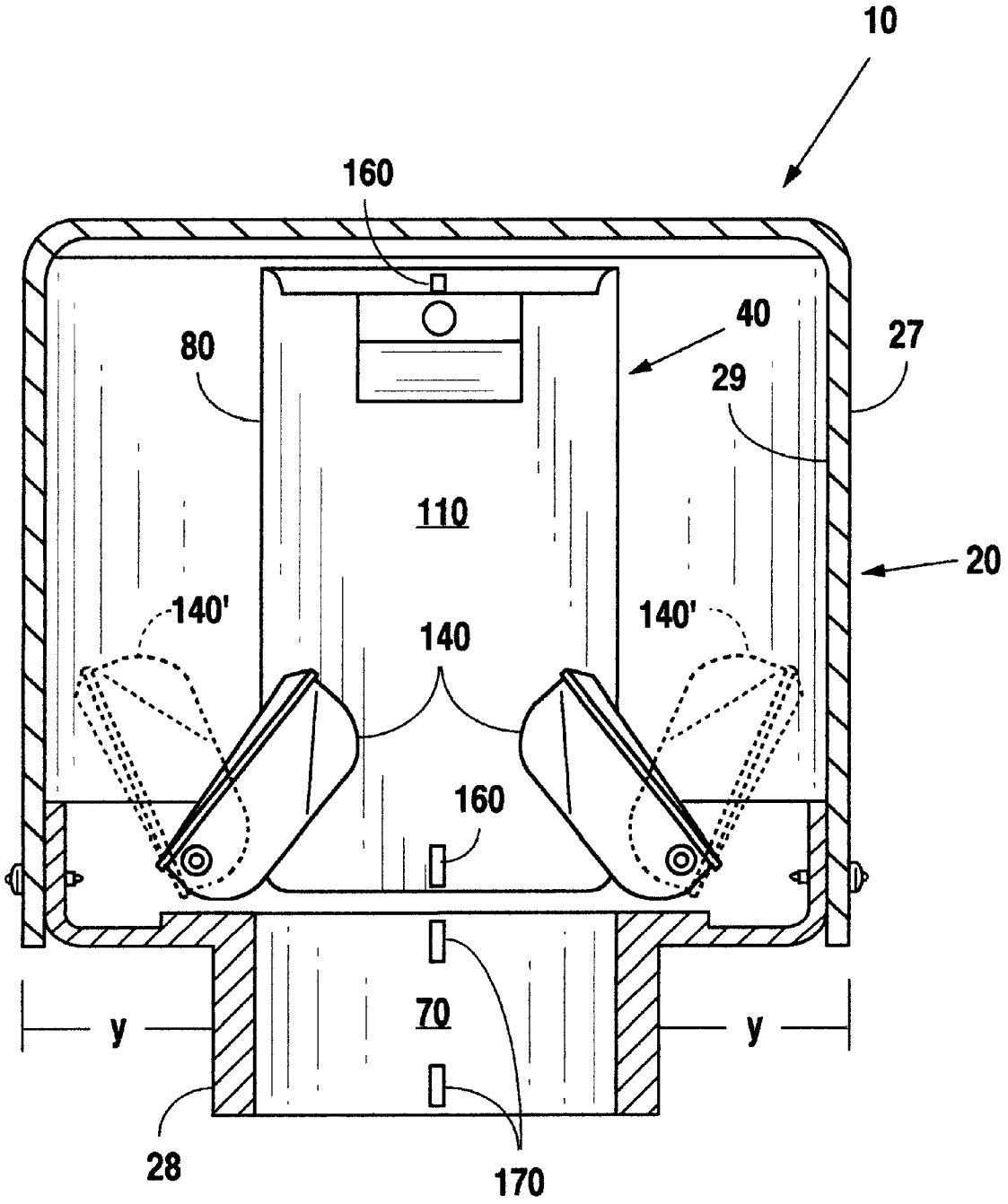
FIG. 10 is a front, cut-away view of the present invention illustrating the function of the locking means.
Figure 11:
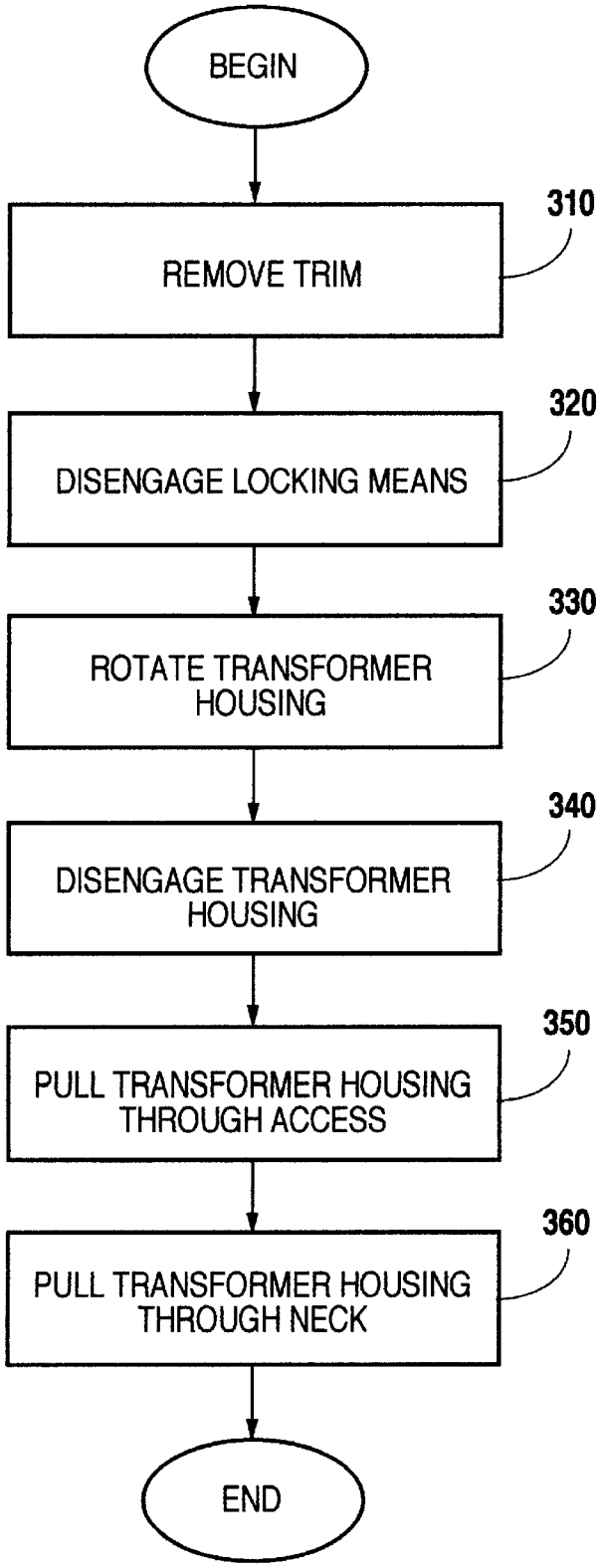
FIG. 11 is a flowchart diagram of the method of the invention.

FIG. 10 illustrates use of the locking means 140 which may be engaged to prevent pivotal movement of the transformer housing 40 in relation to the access aperture 80. As shown, the locking means 140 are engaged in a first position, but may be moved to a second position 140' to allow pivotal movement of the transformer housing 40 within the access aperture 80.

The method of the present invention may be seen most easily by referring to FIGS. 1A, 1B, 10 and 11. The method of servicing an inaccessible lighting fixture 10 comprises the steps of removing (disengaging) the trim assembly 22 at step 310 and disengaging the locking means 140 (e.g., a pair of locking ears 140) from the transformer housing 40 at step 320. Step 330 follows with rotating the transformer housing 40 away from the access aperture 80 and into the fixture housing 20 by pulling the second stop 55 away from the inner surface 29 of the fixture housing 20. Step 340 involves disengaging the transformer housing 40 from the fixture housing 20 by pulling the first stop 50 away from the outer surface 27 of the fixture housing 20 which is followed by, pulling the transformer housing 40 through the access aperture 80 in step 350, and extracting the transformer housing 40 from the fixture housing 20 by pulling the transformer housing 40 through the neck aperture 70 in step 360. The wiring 60 of the fixture 10, shown in FIG. 4, is typically attached to the transformer 90 by way of the access ports 120, and the method may also comprise the steps of disconnecting the wiring 60 from the transformer 90, and drawing the wiring 60 through the access ports 120.

As can be more easily seen in FIG. 10, the locking means 140, in the form of a part of rotatable locking ears 140, are used to secure the transformer housing 40 within the fixture housing 20. The locking means 140, as shown by the solid lines, are engaged in a first position. When moved to the second position 140', the locking means are disengaged, and the transformer housing 40 may be freely moved within the confines of the access aperture 80 and fixture housing 20, as shown in FIG. 1B. Of course, other locking means, such as cams, levers, thumb screws, tabs, hook and loop fasteners, and magnetic devices, can be used to secure the transformer housing 40 within the fixture housing 20 so as to prevent pivotal movement of the transformer housing 40, may be used.

The first and second alignment marks 170 and 160 can be used for easy location of the access aperture 80 within the fixture housing 20 after the fixture 10 has been mounted. That is, after mounting the fixture 10, the first alignment mark 170 can be aligned with the second alignment mark 160 such that the transformer housing 140 can be easily maneuvered up through the neck aperture 70 into the access aperture 80 for pivotal placement and engagement with the fixture housing 20. This process is best understood by examining FIGS. 1B and 9. The second and third alignment marks 170 and 163 can be used for easy location of the trim assembly 22 in relation to the inner surface of the neck 25. That is, after mounting the fixture 10, the second alignment mark 170 can be aligned with the third alignment mark 163 such that the trim assembly 22, including the trim ring 30, can be easily positioned such that any rotatable lamp retainer (not shown) can be precisely placed for adjustment and illumination of a preselected area.

Figure 12A:
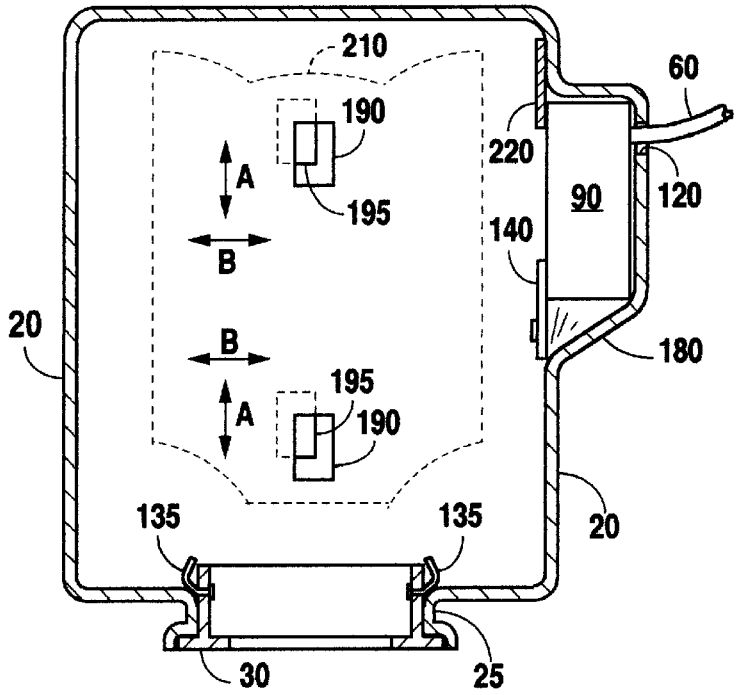
FIGS. 12A and 12B are side, cut-away views of the fixture housing of the present invention, illustrating an alternative means of fixture mounting and trim-engagement.

Turning now to FIG. 12A, alternative means of trim engagement means 135, such as flange clips 135, can be seen. As noted above, the use of ball plungers 130, or other trim assembly 22 engagement means, such as the flange clips 135, such as frictional surfaces or ratcheting mechanisms, provide rotatable engagement of the trim assembly 22 with the fixture housing 20 for easy post-installation placement of lamp retainer mounting assemblies (not shown) contained within, or attached to, the trim assembly 22. The flange clips 135 are used when economy dictates their use in place of ball plungers 130. While the flange clips 135 do not provide the smooth rotation of the plungers 130, they are essentially functional as a means of rotating the trim ring (and the lamp retainer assembly attached to it, not shown).

Figure 12B:
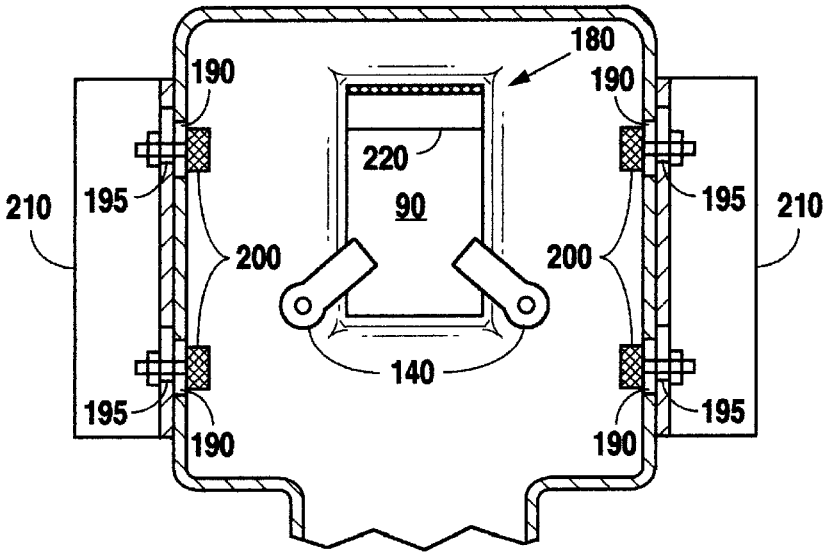

FIGS. 12A and 12B illustrate the use of fixture slots 190 and plate slots 195, used in combination with locking screws 200 to provide fixture 10 movement in the "A" and "B" directions (and combinations thereof) to accommodate ceilings or other mounting surfaces which are non-planar. In use, the mounting plates, or "butterfly" plates as they are known by those skilled in the art, can be nailed or screwed into the framework of the structure in which the fixture 10 is mounted, and the locking screws 200 can be used, along with the fixture slots 190 and plate slots 195, to rotated the entire fixture 10 to accommodate off-vertical mounting, or less than planar mounting surfaces.

FIGS. 12A and 12B also illustrates the use of a transformer recess 180 instead of the transformer housing 40 shown in FIGS. 1–4. In this embodiment of the invention, the transformer 90 is mounted in the transformer recess 180. The inner stop 220 is used to retain the transformer 90 in the recess 180, along with the locking ears 140.

Although the present invention is described in terms of preferred exemplary embodiments, other uses of the invention are contemplated. Such uses are intended to fall within the scope of the following claims. Other aspects, features, and advantages of the present invention may be obtained from a study of this disclosure and the drawings, along with the appended claims.

I claim:

1. A lighting fixture comprising:

a fixture housing including an outer surface, an inner surface, and an access aperture, said fixture housing further including a trim engagement means and a trim ring which is mounted to with said trim engagement means;

a transformer housing including a first stop and a second stops wherein said transformer housing is pivotally engaged with said access aperture, said first stop is located proximate to said outer surface of said fixture housing, and said second stop is located proximate to said inner surface of said fixture housing; and a locking means which may be engaged to prevent pivotal movement of said transformer housing in relation to said access aperture.

2. The fixture of claim 1, wherein said trim engagement means is a ball-bearing plunger.

3. The fixture of claim 1, wherein said fixture housing includes a neck aperture and said transformer housing may be inserted into and removed from said fixture housing by way of said neck aperture.

4. The fixture of claim 3 further including a first alignment mark on said fixture housing and a second alignment mark on said transformer housing, wherein said transformer housing becomes pivotally engaged with said fixture housing when said first and second alignment marks are proximately located, and said transformer housing is inserted into said fixture housing through said neck aperture.

5. The fixture of claim 1 further including a trim assembly having a third alignment mark, and wherein said fixture housing includes a first alignment mark.

6. The fixture of claim 1, wherein said locking means is a pair of locking ears.

7. The fixture of claim 1, wherein said transformer housing includes access ports which operate to enable wire entry into said fixture housing.

8. The fixture of claim 7, wherein said access ports operate to ventilate said fixture housing.

9. The fixture of claim 1, wherein said transformer housing includes a shell, and a transformer is fixedly attached to said shell.

10. The fixture of claim 1, wherein said trim ring is rotatably engaged with said trim engagement means.

11. A method of servicing an inaccessible lighting fixture including a fixture housing having an outer surface, an inner surface, an access aperture, and a neck aperture; a transformer housing having a first stop and a second stop, the transformer housing being pivotally engaged with the access aperture; a locking means engaged to prevent pivotal movement of the transformer housing in relation to the access aperture; and a trim assembly engaged with the fixture housing comprising the steps of:

removing the trim assembly by disengaging the trim assembly from the fixture housing;

disengaging the locking means from the transformer housing;

rotating the transformer housing away from the access aperture and into the fixture housing by pulling the second stop away from the inner surface of the fixture housing;

disengaging the transformer housing from the fixture housing by pulling the first stop away from the outer surface of the fixture housing;

pulling the transformer housing through the access aperture; and extracting the transformer housing from the fixture housing by pulling the transformer housing through the neck aperture.

12. The method of claim 11, wherein said trim assembly includes a trim engagement means and a trim ring which is mounted to said trim engagement means, and wherein said step of removing the trim assembly from the fixture housing further includes the step of disengaging said trim ring from said trim engagement means.

13. The method of claim 12, wherein the trim engagement means is a ball-bearing plunger.

14. The method of claim 12, wherein the trim engagement means is a compression spring.

15. The method of claim 11, wherein the locking means is a pair of locking ears.

16. The method of claim 11, wherein the transformer housing is attached to a transformer and includes access ports, further including the steps of:

disconnecting wiring from the transformer; and drawing the wiring through the access ports.

17. A lighting fixture comprising:

a fixture housing including an outer surface, an inner surface, and an access aperture;

a transformer housing including a first stop and a second stop, wherein the transformer housing is pivotally engaged with the access aperture, the first stop is located proximate to the outer surface of the fixture housing, and the second stop is located proximate to the inner surface of the fixture housing;

a trim ring mounted to the fixture housing; and a pair of locking ears which, when engaged, prevent pivotal movement of the transformer housing in relation to the access aperture.

18. The fixture of claim 17, wherein the fixture housing includes a neck aperture and the transformer housing may be inserted into and removed from the fixture housing by way of the neck aperture.

19. The fixture of claim 18, comprising a first alignment mark located on the fixture housing and a second alignment mark located on the transformer housing, wherein the transformer housing becomes pivotally engaged with the fixture housing when the first and second alignment marks are proximately located, and the transformer housing is inserted into the fixture housing through the neck aperture.

20. The fixture of claim 17, wherein the transformer housing includes access ports which operate to enable wire entry into the fixture housing and to ventilate the fixture housing.

21. A lighting fixture for housing a lamp retainer assembly and a transformer, said lighting fixture comprising:

a fixture housing including an outer surface, an inner surface, a trim engagement means constructed and arranged for mounting a trim ring;

a transformer recess including an inner stop, wherein the transformer is pivotally engaged with the inner stop; and a locking means which may be engaged to prevent pivotal movement of the transformer in relation to the transformer recess.

22. The fixture of claim 21, wherein said trim engagement means is a ball-bearing plunger.

23. The fixture of claim 21, wherein said trim engagement means is a flange clip.

24. The fixture of claim 21, wherein said trim engagement means is a compression spring.

25. The fixture of claim 21, wherein said fixture housing includes a neck aperture and the transformer may be inserted into and removed from said fixture housing by way of said neck aperture.

26. The fixture of claim 21, wherein said locking means is a pair of locking ears.

27. The fixture of claim 21, wherein said transformer recess includes access ports which operate to enable wire entry into the fixture housing.

28. The fixture of claim 21, wherein a trim assembly is rotatably engaged with aid fixture housing.

* * * * *